US010836605B2

(12) United States Patent
Roussel

(10) Patent No.: US 10,836,605 B2
(45) Date of Patent: Nov. 17, 2020

(54) ELEVATOR CAR WITH A FOLDABLE BALUSTRADE AND CONTROL DEVICE FOR AN ELEVATOR INSTALLATION HAVING SUCH AN ELEVATOR CAR

(71) Applicant: Inventio AG, Hergiswil (CH)

(72) Inventor: Frank Roussel, Lucerne (CH)

(73) Assignee: INVENTIO AG, Hergiswil NW (CH)

( * ) Notice: Subject to any disclaimer, the term of this patent is extended or adjusted under 35 U.S.C. 154(b) by 333 days.

(21) Appl. No.: 16/063,324

(22) PCT Filed: Dec. 15, 2016

(86) PCT No.: PCT/EP2016/081227
§ 371 (c)(1),
(2) Date: Jun. 18, 2018

(87) PCT Pub. No.: WO2017/102966
PCT Pub. Date: Jun. 22, 2017

(65) Prior Publication Data

US 2018/0362298 A1 Dec. 20, 2018

(30) Foreign Application Priority Data

Dec. 18, 2015 (EP) ..... 15201273

(51) Int. Cl.
*B66B 5/00* (2006.01)

(52) U.S. Cl.
CPC ..... *B66B 5/0081* (2013.01)

(58) Field of Classification Search
CPC ..... B66B 5/0081; B66B 5/0087
See application file for complete search history.

(56) References Cited

U.S. PATENT DOCUMENTS 6,543,584 B1 * 4/2003 Miyakoshi ..... B66B 5/0081 182/113
6,830,127 B2 * 12/2004 Johnson ..... E02D 29/12 182/113
7,281,609 B2 * 10/2007 Del Rio Sanz ..... B66B 5/0062 182/113
9,764,925 B2 * 9/2017 Cheng ..... B66B 5/0062
(Continued)

FOREIGN PATENT DOCUMENTS

EP 2033927 A1 11/2009
EP 2295363 A1 3/2011
GB 2158038 A 11/1985

*Primary Examiner* — Michael A Riegelman
(74) *Attorney, Agent, or Firm* — William J. Clemens; Shumaker, Loop & Kendrick, LLP

(57) ABSTRACT

An elevator car has at least one balustrade attached to a roof of the elevator car, which balustrade can be pivoted about a rotation axis between a folded-down position, in which the balustrade is arranged essentially horizontally, and a raised position, in which the balustrade is arranged essentially vertically. The balustrade is mechanically coupled to a 3-state switch, which switch can adopt three different switching states. The balustrade and the 3-state switch thus cooperate such that the 3-state switch adopts a first switching state when the balustrade is in the folded-down position, the 3-state switch adopts a second switching state when the balustrade is in the raised position, and the 3-state switch adopts a third switching state when the balustrade is in neither the folded-down position nor the raised position.

15 Claims, 2 Drawing Sheets

(56) References Cited

U.S. PATENT DOCUMENTS

| | | | | |
|---|---|---|---|---|
| 2005/0230194 | A1* | 10/2005 | Nakamura | B66B 5/0081 187/401 |
| 2005/0252726 | A1* | 11/2005 | Det | B66B 5/0081 187/401 |
| 2008/0217113 | A1* | 9/2008 | Bonatre | B66B 5/0081 187/401 |
| 2010/0155184 | A1* | 6/2010 | Sirigu | B66B 13/22 187/302 |
| 2013/0092479 | A1* | 4/2013 | Bloch | B66B 5/0081 187/401 |
| 2017/0355561 | A1* | 12/2017 | D'Apice | B66B 5/0081 |
| 2018/0002139 | A1* | 1/2018 | Stepp | B66B 11/0226 |
| 2018/0201478 | A1* | 7/2018 | Ishiguro | B66B 5/0081 |
| 2018/0362298 | A1* | 12/2018 | Roussel | B66B 5/0081 |
| 2019/0135586 | A1* | 5/2019 | Haapaniemi | B66B 5/0081 |
| 2019/0241399 | A1* | 8/2019 | Kattainen | B66B 5/005 |
| 2019/0256323 | A1* | 8/2019 | Schuler | B66B 11/0226 |

* cited by examiner

ELEVATOR CAR WITH A FOLDABLE BALUSTRADE AND CONTROL DEVICE FOR AN ELEVATOR INSTALLATION HAVING SUCH AN ELEVATOR CAR

FIELD

The present invention relates to an elevator car, to the roof of which a foldable balustrade is attached. The invention also relates to a control device for an elevator installation having such an elevator car, and to a correspondingly equipped elevator installation.

BACKGROUND

Elevator installations generally have at least one elevator car which can be moved essentially vertically within an elevator shaft. In this case, the elevator car is retained using a bearing means such as one or more belts or cables. The bearing means can be moved, and the elevator car can thus be moved within the elevator shaft, using a drive machine, such as an electric motor, that drives a drive sheave.

In order to be able to repair or service components of the elevator installation within the elevator shaft for example, it may be provided for a person to get onto a roof of the elevator car in order to be able to carry out work from there on a corresponding component for example. In the case of elevator installations that do not have a machine room, the drive machine may be arranged within the elevator shaft for example, and therefore it is difficult to access from outside the elevator shaft and can be serviced most easily by standing on the roof of the elevator car.

However, in such a case it is necessary to reliably prevent the people on the roof of the elevator car from being able to move beyond a lateral edge of the roof and fall into the elevator shaft. Regulations therefore specify that suitable technical measures must be taken to protect the people from such a fall. Regulations of this kind are specified in European Standard EN 81-21 for example.

For example, a balustrade may be provided on the roof of the elevator car, which balustrade protrudes upwards sufficiently far from the roof of the elevator car to prevent a person from moving beyond an edge of the roof. In general, a balustrade of this kind should protrude upwards above the roof by at least 70 cm, preferably at least 110 cm. The balustrade can be constructed from rails and struts for example, the rails generally protruding perpendicularly upwards from the roof and the struts interconnecting adjacent rails in the horizontal direction.

In elevator installations, it is frequently desirable to keep the elevator shaft as short as possible. In order that it is not necessary to provide additional length in the elevator shaft just for a balustrade that protrudes upwards beyond the elevator car, foldable balustrades have been proposed, which balustrades can be pivoted about a rotation axis between a folded-down position, in which the balustrade is arranged essentially horizontally, and a raised position, in which the balustrade is arranged essentially vertically. Foldable balustrades of this kind are described in GB 2 158 038 A; U.S. Pat. No. 6,543,584; EP 2 033 927 A1 and EP 2 295 363 A1 for example.

In order to be able to ensure safe operation of the elevator installation and in order to be able to reliably prevent, for example, the elevator car from moving too far upwards in the elevator shaft when the balustrade is raised and, in the worst case, the balustrade hitting a ceiling or components of the elevator shaft located there, regulations usually require it to be possible for a current folding state of the foldable balustrade to be able to be identified and to be monitored by an elevator controller. For this purpose, EP 2 033 927 A1 provides a plurality of safety switches for example, one of the safety switches being intended to identify whether the balustrade is in the folded-down position thereof, and another safety switch being intended to monitor whether the balustrade is in the raised position thereof.

In the case of an elevator car, there may be a need for being able to monitor a current folding state of a foldable balustrade in an alternative manner that is preferably technically simple to implement and/or cost-effective.

SUMMARY

A need of this kind can be met by the subject matter of the present invention. Advantageous embodiments are specified in the following description.

According to a first aspect of the present invention, an elevator car is described that comprises a foldable balustrade attached to a roof of the elevator car, which balustrade is mechanically coupled to what is known as a 3-state switch, which switch can adopt three different switching states. In this case, the balustrade and the 3-state switch are designed to cooperate such that the 3-state switch adopts a first switching state when the balustrade is in the folded-down position thereof, the 3-state switch adopts a second switching state when the balustrade is in the raised position thereof, and the 3-state switch adopts a third switching state when the balustrade is in neither the folded-down position nor the raised position thereof. Furthermore, in order to create the mentioned mechanical coupling, the 3-state switch can be directly or (for example via an intermediate mechanism) indirectly connected or connectable to the balustrade by a gearing.

According to a second aspect of the present invention, a control device for an elevator installation comprising an elevator car according to an embodiment of the first aspect of the invention is described, the control device being designed to monitor a current switching state of the 3-state switch mechanically coupled to the balustrade, and to control an operation of the elevator installation on the basis of the switching state.

Possible features and advantages of embodiments of the invention may be considered, among others and without limiting the invention, to be dependent upon the concepts and findings described below.

It has been found that monitoring a foldable balustrade using a plurality of safety switches, as described in EP 2 033 927 A1 for example, is associated with relatively high outlay in terms of apparatus. In this case, the safety switches are designed as simple 2-state switches which distinguish only between an open and a closed state. A first safety switch is used to identify whether or not the balustrade is in the folded-down position. A second switch that is separate therefrom is used to monitor whether or not the balustrade is in the raised position.

A concept on which the present invention is based is that of providing just one switch for the foldable balustrade, it being intended for said switch to be designed such that three different states can be identified thereby, i.e. it is possible to identify whether the balustrade is in the folded-down position, the raised position or neither of these two positions. Providing a single 3-state switch of this kind can result in significant simplification of outlay for apparatus compared with the conventional provision of at least two 2-state switches. In particular, a 3-state switch can simply be designed in a less complex manner than a 2-state switch that is conventionally used for this purpose, it then being possible to dispense with the provision of a further switch, however. Costs for the further switch, the installation thereof and also the wiring thereof can thus be saved. Furthermore, the 3-state switch can easily be mechanically coupled to the balustrade in a suitable manner, in order to be able to safely and reliably detect the different folding states of said balustrade.

According to one embodiment, the 3-state switch may be designed as a rotary switch which can be moved into each of the three different switching states thereof by being rotated about a rotation axis. A rotary switch of this kind can be mechanically coupled to the balustrade such that, when the balustrade is folded into the raised or into the folded-down position thereof, the rotary switch is automatically also rotated so as to be clearly moved into one of the three possible switching states thereof.

The rotary switch is preferably designed and arranged such that the rotation axis thereof is coaxial with the rotation axis of the balustrade. In other words, the balustrade can be pivoted about the same rotation axis as that about which the rotary switch is also to be rotated. A coaxial arrangement of this kind makes it possible for the balustrade and the rotary switch to be mechanically coupled in a simple manner, without it being necessary to provide a mechanical transmission, gearing or another complex mechanical force-transmission mechanism for example.

The 3-state switch can preferably be integrated into a joint, in order that the balustrade can be pivoted thereabout from the folded-down position into the raised and vice versa. In other words, the balustrade can be pivotably attached to the roof of the elevator car by means of a joint, and the 3-state switch can be integrated into said joint such that, when the balustrade is pivoted, said switch is also actuated and is moved appropriately into one of the three different switching states thereof.

In particular the 3-state switch may be designed as a cam switch. In this case, a cam switch of this kind can be understood to be a mechanically actuatable switch, in which an axle or a shaft can be moved into different orientations by means of being rotated about a rotation axis, and at least one radially projecting cam is provided on the axle or shaft, which cam can function, in different orientations that are to be adopted, as an electrical connection element to and/or between fixed electrical contacts.

According to a specific embodiment, the 3-state switch can comprise four electrical terminals and a connection element that is rotatable about a rotation axis, the connection element being mechanically coupled to the pivotable balustrade. In this case, the terminals and the connection element can be designed such that the connection element electrically interconnects a first and a third of the electrical terminals when the balustrade is in the folded-down position, such that the connection element electrically interconnects a second and a fourth of the terminals when the balustrade is in the raised position, and such that the connection element does not electrically connect any of the terminals to another of the terminals when the balustrade is in neither the folded-down position nor the raised position. In a simple embodiment, the connection element can be a linear, electrically conductive component that can be rotated about a rotation axis and that electrically interconnects two terminals that are opposite one another with respect to the rotation axis, depending on the orientation.

Alternatively, the 3-state switch can comprise just three electrical terminals and a connection element that is rotatable about a rotation axis, the connection element again being mechanically coupled to the balustrade. In this case, the terminals and the connection element are designed such that the connection element electrically interconnects a first and a second of the terminals when the balustrade is in the folded-down position, such that the connection element electrically interconnects the second and a third of the terminals when the balustrade is in the raised position, and such that the connection element does not electrically connect any of the terminals to another of the terminals when the balustrade is in neither the folded-down position nor the raised position.

Both the 3-state switch comprising four electrical terminals and the 3-state switch comprising just three electrical terminals can be designed in a simple manner mechanically and electrically, and can be coupled to the balustrade.

The control device used to monitor the current switching state of the 3-state switch can in particular be designed to control the operation of the elevator installation in what is referred to as a normal mode when the first switching state is present, and to control the operation of the elevator installation in what is referred to as an inspection mode when the second switching state is present. In the normal mode, the elevator car should be able to be moved over the entire travel path thereof within the elevator shaft. In the inspection mode, in contrast, the elevator car should not be able to be moved or should at least not be able to be moved over the entire travel path thereof, within the elevator shaft.

In other words, the normal mode is intended to specify the operating state in which the control device of the elevator installation can move the elevator car as desired within the elevator shaft, to all desired positions, since, in this normal state, the travel path of the elevator car is in no way restricted on account of the balustrade which is folded up into the raised position thereof. In the inspection mode, in contrast, the presence of the second switching state of the 3-state switch means that it is identified that the foldable balustrade is in the raised position thereof. In this case, it may be provided for the elevator car to no longer be permitted to be moved at all, since it is assumed that a person is located on the roof of the elevator car and said person should not be endangered by a movement of the elevator car. It can at least, however, be provided that the elevator car may not move over the entire travel path thereof within the elevator shaft, but merely over a limited travel path, in order to prevent, in particular, the balustrade from being moved inadmissibly close to or even into a ceiling of the elevator shaft or elevator shaft components located there for example.

The control device can further be designed to control the operation of the elevator installation in what is known as an exception mode, in which the elevator car cannot be moved within the elevator shaft or can be moved therein only in compliance with additional safety precautions, when the 3-state switch is in the third switching state.

In other words, the control device can identify, using the 3-state switch, that the balustrade is in neither the folded-down position thereof, in which case the 3-state switch would be in its first switching state, and nor is the balustrade in the raised position thereof, in which case the 3-state switch would be in its second switching state. When neither of these two switching states is identified, but instead the 3-state switch is in the third switching state thereof, the control device preferably assumes that the folding state in which the balustrade is located is not known, i.e. that it is not known whether the balustrade is somewhere between the completely folded-down position thereof and the completely raised position thereof, or whether the 3-state switch may be faulty. In such a case, as a precaution, the control device controls the operation of the elevator installation in the exception mode, in which the elevator car either may not be moved at all or specific additional safety precautions must be adhered to, i.e. the elevator car may be moved only very slowly for example, and/or warning signals such as acoustic and/or optical signals should be emitted.

According to another embodiment, a plurality of balustrades may be attached to the roof of the elevator car, each of which balustrades is mechanically coupled to a 3-state switch. In this case, the plurality of 3-state switches can be interconnected in series.

In this case, the series connection of the 3-state switches can be designed such that the control device monitoring the 3-state switches can be designed to control the operation of the elevator installation in the normal mode only when all the 3-state switches are in the respective first switching states thereof.

In other words, the control device is intended to identify that all the balustrades are in the folded-down position thereof and thus all the 3-state switches are in their respective first switching states. Then, and only then, should the control device allow normal movement of the elevator car within the elevator shaft over the entire travel path thereof, i.e. control the elevator installation in a normal mode.

The series connection of the plurality of 3-state switches can further be designed such that the control device can be designed to control the operation of the elevator installation in the inspection mode only when all the 3-state switches are in the second switching state.

In other words, the control device should monitor all the 3-state switches mechanically coupled to the plurality of balustrades, and transition into the inspection mode only when all the 3-state switches are in the second switching state thereof and thus indicate that the associated balustrade is in the raised position thereof. In this case, when all the 3-state switches are in the second switching state thereof, it can be assumed that a person located on the roof of the car can stay there safely due to the fact that all the balustrades are in the raised position thereof.

Folding up the balustrades into the raised position thereof can thus function as a kind of inspection switch, as is required in regulations for example, in order to place an elevator installation into a special inspection mode in the event of a person being located on the elevator roof, in which mode the person is specially protected. In this case, depending on the safety strategy, it may be provided for it to no longer be permissible to move the elevator car within the elevator shaft at all, or at least for the travel path of the elevator car within the elevator shaft to be limited.

Moreover, according to one embodiment, it may be provided to design the series connection of the plurality of 3-state switches such that the control device can be suitably designed so as to control the operation of the elevator installation in the exception mode either when at least one of the 3-state switches is in the third switching state or when the plurality of 3-state switches are in different switching states.

In other words, in the event of a plurality of balustrades being provided but either not all the balustrades being in the folded-down position thereof and the 3-state switches thus all being in the first state thereof, or all the balustrades being in the raised position thereof and thus the associated 3-state switches all being in the third switching state thereof, the control device can be designed to control the operation of the elevator installation in an exception mode, as a precaution, in which mode the elevator car either may not move, or at most may move in a manner taking account of additional safety precautions. In this way, the control device can identify for example when a person located on the roof of the elevator car has not completely folded up all the balustrades, in accordance with regulations, and the person is thus not sufficiently protected with respect to their movement on the elevator roof. Equally, it is also possible to ascertain when balustrades have not all been correctly folded down again into the folded-down position thereof, for example after the person has left the roof, and there may thus be a risk that individual balustrades that are still raised or not completely folded down may collide with the ceiling of the elevator shaft or with components located there in the event of movement of the elevator car.

It shall be noted that some of the possible features and advantages of the invention are described herein with reference to different embodiments, in particular with reference to an elevator car or with reference to the control device. A person skilled in the art recognizes that the features may be combined, adapted, transferred or exchanged as appropriate in order to yield other embodiments of the invention.

Embodiments of the invention shall be described hereinbelow, with reference to the accompanying drawings, neither the drawings nor the description being intended to be interpreted as limiting the invention.

The drawings are only schematic and are not true to scale. Like reference signs refer in different drawings to like or analogous features.

DETAILED DESCRIPTION

Figure 1:
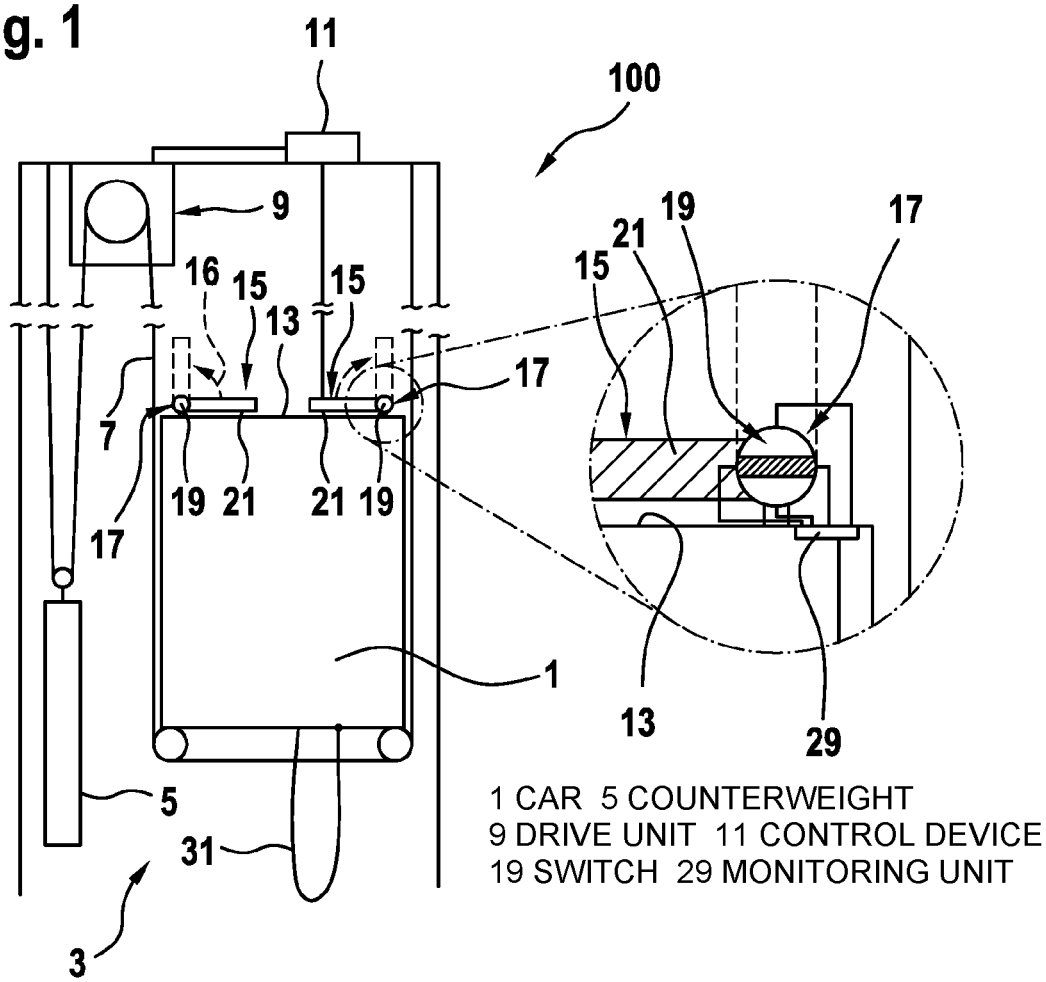
FIG. 1 shows an elevator installation comprising an elevator car and a control device according to an embodiment of the present invention.

FIG. 1 shows an elevator installation 100 in which an elevator car 1 is received in an elevator shaft 3 so as to be vertically movable. The elevator car 1 is held, together with a counterweight 5, by a cable-like bearing means 7 which can be moved by a drive unit 9. The drive unit 9 can be controlled using a control device 11.

Two balustrades 15 are attached to a roof 13 of the elevator car 1. Each of the two balustrades 15 is foldable, i.e. can be pivoted, as indicated by the arrow 16, between a folded-down position (as shown in FIG. 1), in which the balustrade is arranged essentially horizontally and thus in parallel with the roof 13 of the elevator car 1, and a raised position (as shown in dashed lines in FIG. 1), in which the balustrade 15 is arranged essentially vertically and thus perpendicularly to the roof 13 of the elevator car. In this case, a rail 21 can be pivoted about a joint 17 or about a rotation axis formed by said joint 17.

As can be clearly seen in the enlarged detail in FIG. 1, a 3-state switch 19 is integrated into the joint 17 of the balustrade 15. Said 3-state switch 19 is mechanically coupled to the balustrade 15 or to a portion of the balustrade 15 that is pivotable together with the rail 21, such that said switch is also moved when the balustrade 15 is pivoted.

In this case, the 3-state switch 19 is designed to adopt a first switching state when the balustrade 15 is in the folded-down position, and to adopt a second switching state when the balustrade 15 is in the raised position. When the balustrade 15 is in neither the folded-down position nor the raised position, but instead somewhere therebetween, the 3-state switch adopts a third switching state. In the example shown, the 3-state switch is designed as a rotary switch, the rotation axis of which is coaxial with a pivot axis of the balustrade 15.

Figure 2:
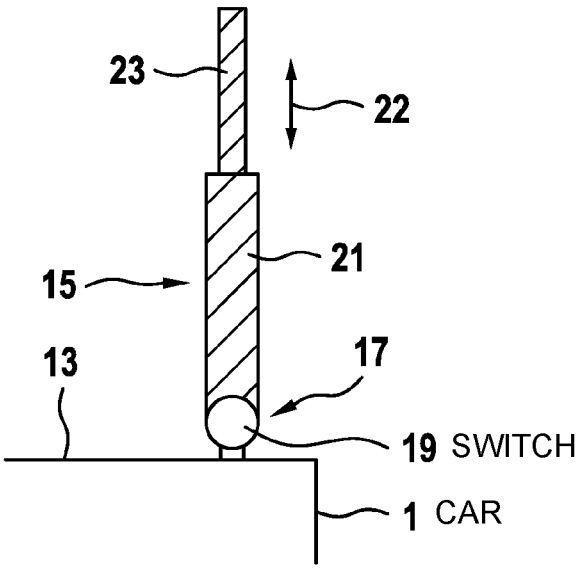
FIG. 2 shows a balustrade for an elevator car according to an alternative embodiment of the present invention.

FIG. 2 shows an optional development of a balustrade 15 for an elevator car 1 according to an alternative embodiment of the invention. In this development, the balustrade 15 is designed as a telescopically extendable balustrade. In this case, the pivotable rail 21 can be extended in the direction of the arrow 22 by pulling out an extension piece 23. In this way, a height which the balustrade 15 reaches can be increased, for example in order to comply with regulations applicable in this regard. When the balustrade 15 is not required and is stored in the folded-down position thereof, the extension piece 23 can be retracted, such that the balustrade 15 requires as little space as possible on the roof 13 of the elevator car 1. The extension piece 23 can increase the height of the balustrade 15 by up to at least 10 cm for example, preferably up to at least 30 cm. Overall, the balustrade 15 can have a height of at least 70 cm, preferably at least 110 cm.

Figure 3:
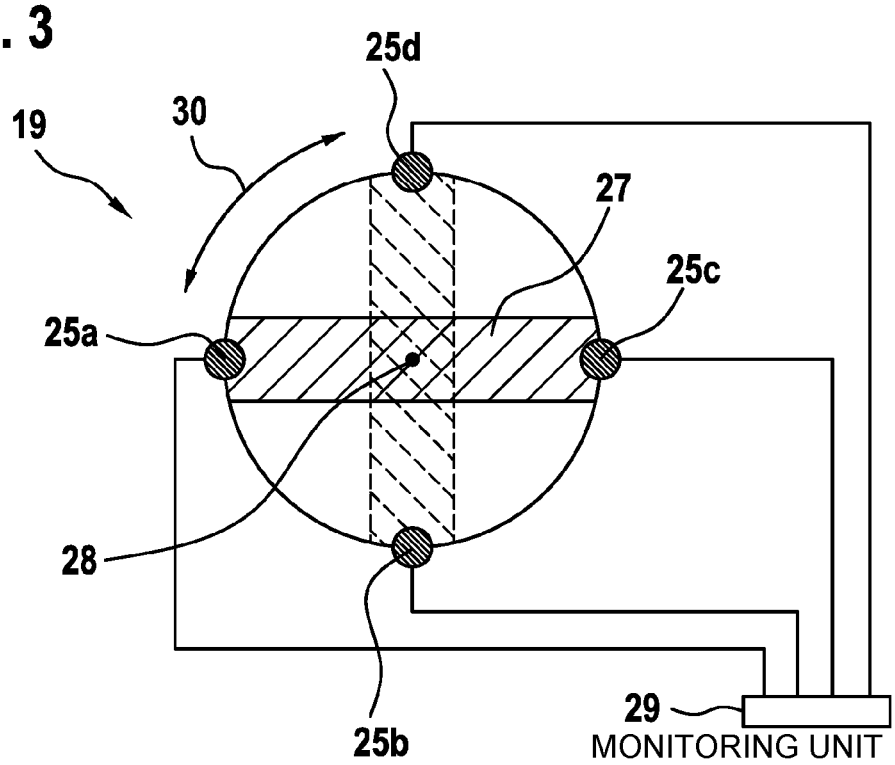
FIG. 3 shows a 3-state switch for an elevator car according to an embodiment of the present invention.
Figure 4:
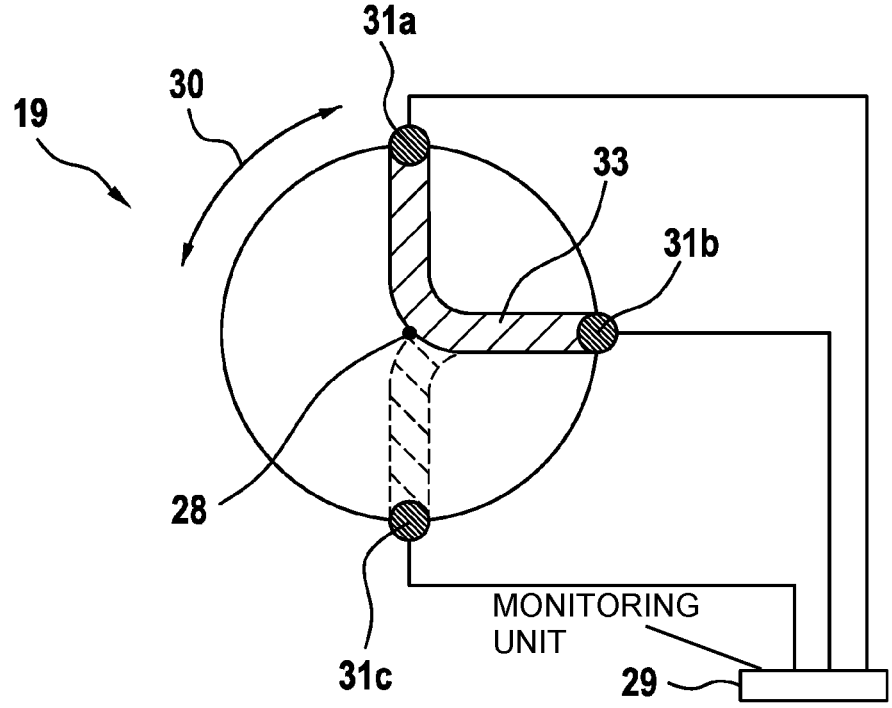
FIG. 4 shows an alternative 3-state switch for an elevator car according to an embodiment of the present invention.

FIGS. 3 and 4 show possible embodiments of a 3-state switch 19, as said switch can advantageously be implemented as a rotary switch, in particular as a cam switch, that is to be coupled to the balustrade 15. In the example shown in FIG. 3, the 3-state switch 19 comprises four electrical terminals 25*a*-25*d*. A connection element 27 is provided between two mutually opposing terminals in each case, which connection element can be rotated about a rotation axis 28, as indicated by the arrow 30. In this case, the linear connection element 27 can electrically interconnect two opposing terminals 25*a*-25*d* in each case. In a first switching state which the 3-state switch 19 adopts when the balustrade 15 mechanically coupled thereto is in the folded-down position thereof, the connection element 27 connects a first and a third terminal 25*a*, 25*c*. In a second switching state, in which the balustrade 15 is in the raised position thereof, the connection element 27 connects a second and a fourth terminal 25*b*, 25*d*. Electrically connecting opposing terminals in each case makes it possible to close corresponding circuits. A monitoring unit 29 can identify this and/or convey this to the control device 11. The monitoring unit 29 may be arranged on the elevator car 1 for example, and transmit corresponding signals to the control device 11 via a data line 32 for example (see FIG. 1).

On the basis of the switching state currently adopted by the 3-state switch 19, as has been identified by the monitoring unit 29 and transmitted to the control device 11, the control device 11 can then appropriately control the elevator installation 100. If it is identified, for example, on the basis of the switching state, that all the balustrades 15 on the roof of the elevator car 1 are stored in the folded-down position thereof, the control device 11 can control the operation of the elevator installation 100 in the normal mode thereof and thus move the elevator car 1 over the entire travel path thereof within the elevator shaft 3. If, however, all the 3-state switches 15 are in the second switching state thereof and thus indicate that all the balustrades 15 on the roof 13 of the car 1 are folded up into the raised position thereof, the control device 11 can assume that an inspection is currently to be carried out, during which a person may stand on the roof 13 of the elevator car 1. Accordingly, the control device 11 controls the operation of the elevator installation 100 in accordance with an inspection mode, and allows the elevator car 1 to move at most over a limited travel path.

If the control device 11 identifies that at least one of the balustrades 15 is in neither the folded-down position thereof nor in the raised position thereof, or if the control device 11 identifies that at least one of the balustrades 15 is in the folded-down position thereof and another of the balustrades is in the raised position thereof, the control device 11 assumes that the elevator installation 100 is to be operated neither in normal mode nor in inspection mode. Instead, the control device 11 transitions into an exception mode in which the elevator car 1 either may not move at all within the elevator shaft 3 or may move therein at most in compliance with additional safety precautions.

FIG. 4 shows a further possible embodiment of a 3-state switch 19, in which just three electrical terminals 31*a*-31*c* are provided. In this case, unlike in the example shown in FIG. 3, a connection element 33 is not straight and does not connect terminals that are opposite one another with respect to the rotation axis 28 of the 3-state switch 19, but instead, in the example shown, said connection element is curved and connects two adjacent terminals of the 3-state switch 19 in each case, which terminals are arranged along the periphery of the 3-state switch 19 so as to be offset from one another by 90° in each case. In this case, in a first switching state, the connection element 33 connects a first and a second terminal 31*a*, 31*b*, whereas, in a second switching state, the connection element 33 electrically interconnects the second and a third terminal 31*b*, 31*c*. As is also the case in the example shown in FIG. 3, the 3-state switch 19 can be transferred from the first switching state into the second switching state and vice versa by means of the balustrade 15 coupled thereto being pivoted 90° in the direction 30.

Other embodiments of 3-state switches 19 can also be implemented. In particular, other geometrical arrangements of terminals and/or connection elements may be provided. Using the 3-state switch 19 it is possible to ascertain with a high degree of reliability whether a balustrade 15 is currently folded down or raised or is in an undefined intermediate state, just one switch being sufficient for identifying all three situations.

Finally, it should be noted that terms such as "comprising" and the like do not preclude other elements or steps, and terms such as "a" or "one" do not preclude a plurality. Furthermore, it should be noted that features or steps that have been described with reference to one of the above embodiments may also be used in combination with other features or steps of other embodiments described above.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator car comprising:

a balustrade attached to a roof of the elevator car, the balustrade being pivotable about a pivot axis between a folded-down position, in which the balustrade is arranged horizontally, and a raised position, in which the balustrade is arranged vertically; and a 3-state switch that can adopt three different switching states, the balustrade being mechanically coupled to the switch, wherein the switch adopts a first of the switching states when the balustrade is in the folded-down position, the switch adopts a second of the switching states when the balustrade is in the raised position, and the switch adopts a third of the switching states when the balustrade is in neither the folded-down position nor the raised position.

2. The elevator car according to claim 1 wherein the 3-state switch is a rotary switch that is moved into each of the three different switching states by being rotated about a rotation axis thereof.

3. The elevator car according to claim 2 wherein the rotary switch is arranged with the rotation axis coaxial with the pivot axis of the balustrade.

4. The elevator car according to claim 1 wherein the 3-state switch is integrated into a joint about which joint the balustrade can be pivoted from the folded-down position into the raised position.

5. The elevator car according to claim 1 wherein the 3-state switch is a cam switch.

6. The elevator car according to claim 1 wherein the 3-state switch includes four electrical terminals and a connection element rotatable about a rotation axis, the connection element being mechanically coupled to the balustrade, wherein the terminals and the connection element cooperate such that:

the connection element electrically interconnects a first and a third of the terminals when the balustrade is in the folded-down position;

the connection element electrically interconnects a second and a fourth of the terminals when the balustrade is in the raised position; and the connection element does not electrically connect any of the terminals to another of the terminals when the balustrade is in neither the folded-down position nor the raised position.

7. The elevator car according to claim 1 wherein the 3-state switch includes three electrical terminals and a connection element rotatable about a rotation axis, the connection element being mechanically coupled to the balustrade, wherein the terminals and the connection element cooperate such that:

the connection element electrically interconnects a first and a second of the terminals when the balustrade is in the folded-down position;

the connection element electrically interconnects the second terminal and a third of the terminals when the balustrade is in the raised position; and the connection element does not electrically connect any of the terminals to another of the terminals when the balustrade is in neither the folded-down position nor the raised position.

8. The elevator car according to claim 1 wherein a plurality of the balustrade is attached to the roof of the elevator car, each of the balustrades being mechanically coupled to an associated one of a plurality of the 3-state switch, and wherein the switches are interconnected in series.

9. A control device for an elevator installation including the elevator car according to claim 1 wherein the control device monitors a current one of the switching states of the 3-state switch mechanically coupled to the balustrade and controls an operation of the elevator installation based on the current switching state.

10. The control device according to claim 9 wherein the control device controls the operation of the elevator installation in:

a normal mode, in which the elevator car can be moved over an entire travel path thereof within an elevator shaft, when the first switching state is present; and an inspection mode, in which the elevator car cannot be moved or at least cannot be moved over the entire travel path thereof within the elevator shaft, when the second switching state is present.

11. The control device according to claim 10 including a plurality of the balustrade attached to the roof of the elevator car, each of the balustrades being mechanically coupled to one of a plurality of the 3-state switch, wherein the switches are interconnected in series and the control device controls the operation of the elevator installation in the normal mode only when all of the 3-state switches are in the first switching state.

12. The control device according to claim 10 including a plurality of the balustrade attached to the roof of the elevator car, each of the balustrades being mechanically coupled to one of a plurality of the 3-state switch, wherein the switches are interconnected in series and the control device controls the operation of the elevator installation in the inspection mode only when all of the switches are in the second switching state.

13. The control device according to claim 9 wherein the control device controls the operation of the elevator installation in an exception mode wherein the elevator car cannot be moved within an elevator shaft or can be moved in the elevator shaft only in compliance with additional safety precautions when the third switching state is present.

14. The control device according to claim 13 including a plurality of the balustrade attached to the roof of the elevator car, each of the balustrades being mechanically coupled to one of a plurality of the 3-state switch, wherein the switches are interconnected in series and the control device controls the operation of the elevator installation in the exception mode only when at least one of the switches is in the third switching state or when at least one of the switches is in a different switching state than another of the switches.

15. An elevator installation including an elevator car comprising:

a balustrade attached to a roof of the elevator car, the balustrade being pivotable about a pivot axis between a folded-down position, in which the balustrade is arranged horizontally, and a raised position, in which the balustrade is arranged vertically;

a 3-state switch that can adopt three different switching states, the balustrade being mechanically coupled to the switch, wherein the switch adopts a first of the switching states when the balustrade is in the folded-down position, the switch adopts a second of the switching states when the balustrade is in the raised position, and the switch adopts a third of the switching states when the balustrade is in neither the folded-down position nor the raised position; and a control device monitoring a current one of the switching states of the 3-state switch mechanically coupled to the balustrade and controlling an operation of the elevator installation based on the current switching state.

* * * * *